US006300001B1

(12) United States Patent
Hornung et al.

(10) Patent No.: US 6,300,001 B1
(45) Date of Patent: Oct. 9, 2001

(54) FUEL CELL AND USE OF IRON-BASED ALLOYS FOR THE CONSTRUCTION OF FUEL CELLS

(75) Inventors: Regina Hornung, Erlangen; Siegfried Birkle, Höchstadt; Manfred Waidhas, Nürnberg, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/341,938

(22) PCT Filed: Jan. 7, 1998

(86) PCT No.: PCT/DE98/00027

§ 371 Date: Jul. 20, 1999

§ 102(e) Date: Jul. 20, 1999

(87) PCT Pub. No.: WO98/33224

PCT Pub. Date: Jul. 30, 1998

(30) Foreign Application Priority Data

Jan. 22, 1997 (DE) ..... 197 02 119

(51) Int. Cl.[7] ..... H01M 8/02; H01M 1/12
(52) U.S. Cl. ..... 429/44; 429/34; 429/40
(58) Field of Search ..... 429/34, 40, 44

(56) References Cited

U.S. PATENT DOCUMENTS 4,448,856 * 5/1984 Zukerbrod ..... 429/27
5,399,438 * 3/1995 Tateishi ..... 428/548
5,565,167 10/1996 Fujimoto et al. .
5,624,769 * 4/1997 Li ..... 429/32
6,114,058 * 9/2000 Jodkins ..... 429/13

FOREIGN PATENT DOCUMENTS 0 629 015 A1 * 4/1994 (EP) .
05079060 * 12/1993 (JP) ..... H01M/8/12
05339679A * 12/1993 (JP) ..... H01M/8/02
06010099A * 1/1994 (JP) ..... H01M/8/02
2000239806A * 9/2000 (JP) ..... H01M/8/02
WO9925890A1 * 11/1998 (WO) ..... H01M/8/12

OTHER PUBLICATIONS

Patent Abstracts of Japan Application No. 05079060 dated Mar. 12, 1993.

* cited by examiner

*Primary Examiner*—Gabrielle Brouillette
*Assistant Examiner*—Mark Ruthkosky
(74) *Attorney, Agent, or Firm*—Schiff Hardin & Waite

(57) ABSTRACT

A fuel cell is provided which includes iron-based alloys for the construction of the solid parts of the fuel cell. The fuel cell includes a membrane electrode unit and solid constructive parts which may include current collectors, a cell frame and a bipolar plate. At least one of these solid constructive parts is made from an iron-based material that preferably has an effective weight percent of iron of greater than or equal to 26.9 percent.

10 Claims, No Drawings

FUEL CELL AND USE OF IRON-BASED ALLOYS FOR THE CONSTRUCTION OF FUEL CELLS

The invention relates to a fuel cell that comprises a membrane electrode unit, two current collectors and/or a cell frame or a bipolar plate, whereby at least one solid constructive part is characterized by low weight and high corrosion resistance of the material used.

BACKGROUND OF THE INVENTION

Up to now, cell frames, bipolar plates, collector plates, and/or other solid constructive parts of fuel cells, in particular of low-temperature fuel cells such as the PEM fuel cell, have been known that are manufactured from graphite or other carbonaceous materials. The thickness of the plates ranges from at least 2 to 2.5 mm, due to the gas and liquid distribution structure, and, despite the low density of the plate material the plate cause the cells to have a comparatively high weight and large volume.

In EP 0 629 015 Al, the following alloys or metals are disclosed as materials for bipolar or collector plates: aluminum, titanium or alloys thereof, zirconium, niobium, tantalum, or alloys of these five elements. In addition, it is there disclosed that these elements can be passivated by protective electrically insulating oxides, and that, alternatively to the above-named metals, the plates can also be made of more corrosion-resistant materials such as graphite, high-alloy stainless steel, or nickel-chromium alloys. However, more precise statements concerning the composition of well-suited alloys of these metals have not been known up to now.

For mass production, the carbonaceous materials are too heavy and too expensive in the manufacture of cell frames, current collectors and/or bipolar plates, etc. In turn, the metals have an excessively high susceptibility to corrosion, and, due to their passivation by oxide layer formation, have excessively high losses during current transport inside the fuel cell.

Therefore there is a need for a fuel cell suitable for mass production, in which the collector plates and/or cell frames and/or other constructive parts of the fuel cell are made of a material that

- is economical and corrosion-resistant (even in direct contact with the acid membrane electrolytes), and
- is easily transformable (good deep-drawing quality), and
- has a low contact resistance, and finally
- has a low thickness and, above all, a low weight in the processing into plates, despite the gas and liquid distribution structure.

The subject matter of the invention is a fuel cell that comprises a membrane electrode unit, two current collectors and,or a cell frame and/or a bipolar plate, whereby the material of at least one of the solid constructive parts is made of an Fe-based material selected from the alloys with the following compositions:

| | |
|---|---|
| C content: | 0–0.06 weight % |
| Si content: | 0–2 weight % |
| Cr content: | 8.25–46.5 weight % |
| Mo content: | 1.25–14.0 weight % |
| Ni content: | 2.25–40.5 weight % |
| Cu content: | 0–4.0 weight % |

-continued

| | |
|---|---|
| Mn content: | 0–13 weight % |
| N content: | 0.02–1 weight % |
| Nb content: | 0–0.5 weight % |
| P content: | 0–0.09 weight % |
| S content: | 0–0.06 weight % |
| Fe content: | remainder to 100 weight % |

As an iron-based material, Fe is in principle the main component of the inventively used alloy, whereby the designation main component cannot be defined by percent indications, but rather is regarded relative to the other components.

Moreover, the subject matter of the present invention is the use of an iron-based alloy with one of the above-named compositions in the construction of a fuel cell.

Advantageous constructions of the invention result from the subclaims, as well as from the specification and the examples.

SUMMARY OF THE INVENTION

The Fe-based material for the current collectors and/or the cell frame and/or the bipolar plate is preferably selected from the following alloys:

| | |
|---|---|
| C content: | 0–0.03 weight % |
| Si content: | 0–1 weight % |
| Cr content: | 16.5–25.0 weight % |
| Mo content: | 2.5–7.0 weight % |
| Ni content: | 4.5–26.0 weight % |
| Cu content: | 0–2.0 weight % |
| Mn content: | 0–6.5 weight % |
| N content: | 0.04–0.5 weight % |
| Nb content: | 0–0.25 weight % |
| P content: | 0–0.045 weight % |
| S content: | 0–0.03 weight % |
| Fe content: | remainder to 100 weight % |

Given homogenous alloy element distribution, the relative hole and gap corrosion resistance of a non-rusting steel can be estimated by means of the effective sum (effective sum W=% Cr+3.3. ×% Mo+30 ×% N). In a preferred construction of the invention, the Fe-based material for the at least one solid constructive part is selected of an alloy whose effective Sum is ≧26.9, and particularly preferably one whose effective sum is >30.

In a particularly preferred construction, the Fe-based material is additionally surface-treated in order to reduce the contact resistance. Gold plating, or also treatment c.g. with titanium nitride, are possibilities for such surface treatments. However, the surface treatment can also be realized by coating with conductive polymer plastics. In principle, all known surface treatments can be used here for the lowering of the contact resistance with the same or improved corrosion resistance.

'Solid constructive part' refers here to e.g. cell frames, current collectors and/or collector plates, bipolar plates, terminating and/or pole plates, or some other constructive part, such as a frame element, etc., that is usefully constructed from a material whose shape is stable under normal conditions. These can be square, round, tubular, and other constructive parts that can have arbitrary stamped or otherwise formed surface structures, in which either a cooling medium or a reaction medium then flows, or into which the membrane electrode unit is also clamped. Finally, it can also be a scaling element. In practice, an axial channel or a tension rod, or a part of an axial channel or of a tension rod, can also be made of the inventively used material.

In other words, any additional constriction material of a fuel cell can be selected from the inventively named alloys, except for the polymer electrolyte membrane and the two electrodes adjacent to this membrane.

The design in the patent DE 44 42 285 for the construction of a fuel cell provides for the use of production methods suitable for mass production, such as stamping and pressing, on the materials. The inventively named Fe-based materials are suitable for Such processing techniques.

For use as plates with a gas and/or liquid distribution structure, the inventively used Fe-based materials have a small thickness from 20 to 300 $\mu$m, preferably 50 to 200 $\mu$m, and particularly preferably approximately 100 $\mu$m. For use as pole or terminating plates, or other applications, in some circumstances entirely other plate thicknesses are useful. According to the solid constructive part for which the alloy is used according to the invention, the weight reduction of the fuel cell achieved according to the invention increases naturally with the thickness of the part.

In the fuel cells specified in the above-cited patent, both the pole plates and also the terminal plates and the frame elements can be made from the materials, resulting in a considerable reduction in weight in relation to the prior art.

In the following, the invention is further specified on the basis of alloys that are preferably used:

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

| | |
|---|---|
| Alloy 1.4539 (material numbers) | |
| C content: | 0–0.02 weight % |
| Cr content: | 19.0–21.0 weight % |
| Mo content: | 4.0–5.0 weight % |
| Ni content: | 24.0–26.0 weight % |
| Cu content: | 1.0–2.0 weight % |
| N content: | 0.04–0.15 weight % |
| Fe content: | remainder to 100 weight % |
| Alloy 1.4462: | |
| C content: | 0–0.03 weight % |
| Cr content: | 21.0–23.0 weight % |
| Mo content: | 2.5–3.5 weight % |
| Ni content: | 4.5–6.5 weight % |
| N content: | 0.08–0.2 weight % |
| Fe content: | remainder to 100 weight % |
| Alloy 1.4439: | |
| C content: | 0–0.03 weight % |
| Cr content: | 16.5–18.5 weight % |
| Mo content: | 4.0–5.0 weight % |
| Ni content: | 12.5–14.5 weight % |
| N content: | 0.12–0.22 weight % |
| Fe content: | remainder to 100 weight % |
| Alloy 1.4565: | |
| C content: | 0–0.03 weight % |
| Cr content: | 23.0–25.0 weight % |
| Mo content: | 3.5–4.5 weight % |
| Ni content: | 16.0–18.0 weight % |

-continued

| | |
|---|---|
| Mn content: | 5.0–6.5 weight % |
| N content: | 0.4–0.5 weight % |
| Nb content: | 0–0.10 weight % |
| Fe content: | remainder to 100 weight % |
| Alloy 1.4529: | |
| C content: | 0–0.02 weight % |
| Si content: | 0–1 weight % |
| Cr content: | 19.0–21.0 weight % |
| Mo content: | 6.0–7.0 weight % |
| Ni content: | 24.0–26.0 weight % |
| Cu content: | 0.5–1.5 weight % |
| Mn content: | 0–2.0 weight % |
| N content: | 0.1–0.25 weight % |
| P content: | 0–0.03 weight % |
| S content: | 0–0.015 weight % |
| Fe content: | remainder to 100 weight % |
| and alloy 1.3964: | |
| C content: | 0–0.03 weight % |
| Si content: | 0–1 weight % |
| Cr content: | 20.0–21.5 weight % |
| Mo content: | 3.0–3.5 weight % |
| Ni content: | 15.0–17.0 weight % |
| Mn content: | 4.0–6.0 weight % |
| N content: | 0.2–0.35 weight % |
| Nb content: | 0–0.25 weight % |
| P content: | 0–0.025 weight % |
| S content: | 0–0.001 weight % |
| Fe content: | remainder to 100 weight % |

With the inventively proposed alloys, fuel cells suitable for mass production can be manufactured economically, and a light and compact construction can thereby be realized. In addition, the inventively cited materials have a comparatively high resistance to corrosion, even given direct contact of the plates and/or of the frame elements with the acid electrolytes. In addition, they have a good deep drawing quality, and are also well able to be transformed. Finally, they have a low contact resistance, which can be further optimized by corresponding surface treatment.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A fuel cell comprising a membrane electrode unit and a plurality of solid constructive parts selected from a group consisting of a plurality of current collectors, a cell frame, and a bipolar plate, at least one of the solid constructive parts comprising a Fe-based material comprising the following composition:

Cr content: 8.25–46.5 weight %

Mo content: 1.25–14.0 weight %

Ni content: 2.25–40.5 weight %

N content: 0.02–1 weight %

Fe content: remainder to 100 weight %, wherein the Fe-based material comprises an effective sum greater than or equal to 26.9, and effective sum is defined as Pitting Resistance Equivalent (PRE).

2. The fuel cell of claim 1, wherein the Fe-based material further comprises the following composition:

Cr content: 16.5–25.0 weight %

Mo continent: 2.5–7.0 weight %

Ni content: 4.5–26.0 weight %

N content: 0.04–0.5 weight %

Fe content: remainder to 100 weight %.

3. The fuel cell of claim 1, wherein the Fe based material further comprises the following composition:

C content: 0.–0.03 weight %

Si content: 0–1 weight %

Cu content: 0–2.0 weight %

Mn content: 0–6.5 weight %

Nb content: 0–0.25 weight %

P content: 0–0.045 weight %

S content 0–0.03 weight %

Fe content: remainder to 100 weight %.

4. The fuel cell of claim 1, wherein the Fe-based material is surface treated.

5. The fuel cell of claim 1, wherein the fuel cell is a PEM fuel cell.

6. A method of constructing a fuel cell comprising solid constructive parts, the method comprising the step of fabricating the solid constructive parts from an Fe-based alloy comprising the composition:

Cr content: 8.25–46.5 weight %

Mo content: 1.25–14.0 weight %

Ni content: 2.25–40.5 weight %

N content: 0.02–1 weight %

Fe content: remainder to 100 weight %, wherein the Fe-based material comprises an effective sum greater than or equal to 26.9, and effective sum is defined as Pitting Resistance Equivalent (PRE).

7. The method of claim 6, wherein the Fe-based material further comprises the following composition:

Cr content: 16.5–25.0 weight %

Mo content: 2.5–7.0 weight %

Ni content: 4.5–26.0 weight %

N content: 0.04–0.5 weight %

Fe content: remainder to 100 weight %.

8. The method of claim 6, wherein the Fe-based material further comprises the following composition:

C content: 0–0.03 weight %

Si content: 0–1 weight %

Cu content: 0–2.0 weight %

Mn content: 0–6.5 weight %

Nb content: 0–0.25 weight %

P content: 0–0.045 weight %

S content: 0–0.03 weight %

Fe content: remainder to 100 weight %.

9. The method of claim 6, wherein the Fe based material is surface treated.

10. The method of claim 6, wherein the fuel cell is a PEM fuel cell.

* * * * *